US007455305B2

(12) United States Patent
Bellehumeur et al.

(10) Patent No.: US 7,455,305 B2
(45) Date of Patent: Nov. 25, 2008

(54) VERTICALLY RECIPROCATING SKATE BRAKE

(75) Inventors: Alexander R. Bellehumeur, Long Beach, CA (US); James Woods, Tustin, CA (US)

(73) Assignee: Alex Bellehumeur, Trustee of the Alex Bellehumeur Family Trust dated August 24, 1988, Long Beach, CA (US)

( * ) Notice: Subject to any disclaimer, the term of this patent is extended or adjusted under 35 U.S.C. 154(b) by 406 days.

(21) Appl. No.: 11/301,067

(22) Filed: Dec. 12, 2005

(65) Prior Publication Data

US 2007/0132201 A1 Jun. 14, 2007

(51) Int. Cl.
*A63C 17/14* (2006.01)

(52) U.S. Cl. ..... 280/11.215; 188/29

(58) Field of Classification Search ..... 188/4 B, 188/4 R, 29; 280/11.19–11.223
See application file for complete search history.

(56) References Cited

U.S. PATENT DOCUMENTS

| | | | | |
|---|---|---|---|---|
| 3,900,203 | A | 8/1975 | Kukulowicz | |
| 4,799,701 | A | 1/1989 | Lindau et al. | |
| 5,088,748 | A | 2/1992 | Koselka et al. | |
| 5,226,673 | A | 7/1993 | Cech | |
| 5,232,231 | A | 8/1993 | Carlsmith | |
| 5,351,974 | A | 10/1994 | Cech | |
| 5,415,419 | A | 5/1995 | Bourque | |
| 5,464,235 | A | 11/1995 | Goldman et al. | |
| 5,639,104 | A | 6/1997 | Haldemann | |
| 5,752,707 | A | 5/1998 | Cottle et al. | |
| 5,755,449 | A | 5/1998 | Pozzobon | |
| 5,758,884 | A | 6/1998 | Flater | |
| 5,769,433 | A | 6/1998 | Zorzi et al. | |
| 5,803,468 | A | 9/1998 | Petrucci et al. | |
| 5,836,590 | A | 11/1998 | Mitchell et al. | |
| 5,848,796 | A | 12/1998 | Meibock et al. | |
| 5,882,019 | A | 3/1999 | Pellegrini, Jr. et al. | |
| 5,895,061 | A | 4/1999 | Gignoux | |
| 5,897,170 | A | 4/1999 | Keleny | |
| 5,908,197 | A | 6/1999 | Strothmann et al. | |
| 5,924,704 | A | 7/1999 | Johnson | |
| 5,927,728 | A | 7/1999 | Gignoux et al. | |
| 5,938,213 | A * | 8/1999 | Gignoux | 280/11.211 |

(Continued)

FOREIGN PATENT DOCUMENTS

| | | | |
|---|---|---|---|
| DE | 10107152 | A1 | 8/2002 |

(Continued)

*Primary Examiner*—Christopher P Schwartz
(74) *Attorney, Agent, or Firm*—Fulwider Patton LLP

(57) ABSTRACT

A skate brake particularly suited for an inline skate includes a braking carriage formed of left and right plates spaced apart by axles that support rollers thereon. The rollers engage the wheels of the skate when the carriage is maneuvered to the appropriate elevation, and the momentum of the wheels is arrested as a result of a frictional bearing of the rollers against the carriage surface. The carriage is raised and lowed by a rocker mounted below the skate and coupled to the carriage plates, where rotation of the rocker drives the plates and the carriage downward such that the rollers contact one or more wheels. The rocker is actuated by a linkage that includes a pushrod and a second rocker that is mounted to the skate boot, allowing the user to control the braking carriage by applying pressure to a rear location of the boot.

20 Claims, 4 Drawing Sheets

U.S. PATENT DOCUMENTS

| | | | | |
|---|---|---|---|---|
| 5,984,323 | A | 11/1999 | Daley | |
| 5,997,015 | A | 12/1999 | Bellehumeur | |
| 6,010,136 | A | 1/2000 | Hoskin | |
| 6,039,330 | A | 3/2000 | Hoskin | |
| 6,065,761 | A * | 5/2000 | Gignoux et al. | 280/11.214 |
| 6,102,168 | A | 8/2000 | Brandriff et al. | |
| 6,131,920 | A | 10/2000 | Roman et al. | |
| 6,131,922 | A | 10/2000 | Kludos | |
| 6,135,464 | A * | 10/2000 | Borel | 280/11.221 |
| 6,425,587 | B1 * | 7/2002 | Moon | 280/11.206 |
| 6,446,982 | B1 | 9/2002 | Gaster et al. | |
| 6,485,034 | B1 * | 11/2002 | Chou | 280/11.28 |
| 6,598,887 | B2 | 7/2003 | Haldemann | |
| 6,666,462 | B2 * | 12/2003 | Bellehumeur et al. | 280/11.215 |
| 2003/0168822 | A1 * | 9/2003 | Bellehumeur et al. | 280/11.215 |
| 2005/0161294 | A1 * | 7/2005 | Bellehumeur et al. | 188/29 |

FOREIGN PATENT DOCUMENTS

| | | |
|---|---|---|
| FR | 2593713 | 8/1987 |
| WO | WO 96/36408 | 11/1996 |

* cited by examiner

VERTICALLY RECIPROCATING SKATE BRAKE

BACKGROUND OF THE INVENTION

The present invention relates generally to roller skates, and more particularly to a braking system for an inline roller skate.

Inline skates were first developed according to industry sources around 1979 and have been growing in popularity ever since. Part of the reason for the recent increase in popularity of inline skating has been the technological advances in the equipment, which continue to make the sport safer and more enjoyable. One industry reports that inline skates has become a billion dollar business world wide, and the popularity of inline skates has led to the advent of inline skate clubs, inline roller hockey leagues, and many other organizations centered around inline skating.

While there have been significant advances made to the equipment, three main concerns of inline skating continue to remain outstanding and require addressing. One is the safety and effectiveness of any braking system used to decelerate the skates, and more particularly the braking distance required to bring the skater to a controlled stop. The second issue stability of the system, where current systems require that the skate be placed at an angle that promotes instability and places the skater at risk for injury. The third issue is the frequency with which braking components wear out and require replacement, for many braking systems currently in use wear far too quickly in the minds of consumers. What is required is a safe and reliable braking system for an inline skate that significantly reduces the effective braking distance in a controllable manner without undue wear on the braking elements.

Early braking systems for inline skates involved a protrusion on the rear boot of the brake comprised of a hard, rubber-like material that could be dragged by the skater to frictionally bring the skater to a stop. This system had many disadvantages, including the need to remove the wheels of the skate from the skating surface leading to instability, and the need to frequently replace the protrusion. Braking in this manner is also awkward and can lead to falls, and the braking distance required for controlled stopping is longer than desired. The prior art showed efforts of more advanced braking systems in an attempt to overcome the shortcomings of the old skate brakes. In U.S. Pat. No. 5,639,104 to Halermann, an inline skate is disclosed with a brake having disks that engage the rear wheel and the penultimate wheel of a four wheel inline skate when the skater displaces his weight backwards. In U.S. Pat. No. 6,065,761 to Gignoux et al., a skate brake is disclosed wherein a cylindrical body is pivoted into frictional contact with the rear and penultimate wheels of an inline skate using a linkage actuated by the rear portion of the skate. U.S. Pat. No. 5,997,015 to the present co-inventor discloses a brake assembly for inline skates that utilizes a brake drum extending outwardly from two inline wheels, where the brake is actuated by a linkage coupled to a pivotable portion of the skate boot. U.S. Pat. No. 6,666,462 to the present co-inventor et al also discloses a brake assembly for inline skates that includes a brake arm supported by a wheel frame, and a brake wheel ring including a radially outwardly facing circular brake contact surface positioned to contact the movable brake arm. U.S. Pat. No. 6,729,628 also to the present co-inventor et al discloses a braking device for an inline skate that includes a rotating brake member partially embedded on one or both sides of a skate wheel, and a fixed brake member positioned adjacent the rotating brake member and bendable to contact the rotating member to effect braking. Lastly, U.S. Pat. No. 6,948,723 to the present co-inventor et al discloses a braking system for inline skates that includes a roller turned by one or more wheels of the skate, where the roller expands outwardly and causes the outer surface to rub against a braking surface to brake the skate. The teachings of the previously identified '723 patent are incorporated herein in full by reference.

While each of these braking systems has their own advantages and disadvantages, the overall goal of reducing braking distance in a safe and controlled manner, along with extending the useful braking system life expectancy, has led to the development of the present invention.

SUMMARY OF THE INVENTION

A brake assembly for an inline skate includes a braking carriage having left and right mounting plates aligned parallel to the skate's wheels and spaced apart by first and second axles. The braking carriage reciprocates in a substantially vertical path between a brake disengaged elevation and a brake engaged elevation, where the elevation of the braking carriage is controlled by the user. Each axle of the braking carriage carries a braking roller, preferably in the form of first and second opposed conical disks aligned such that conical disk contacts two adjacent skate wheels along their inclined lower surfaces for rolling cooperation with the wheels in a non-slip relationship when said braking carriage occupies said brake engaged elevation. Conversely, the conical disks are spaced from said skate wheels when said braking carriage occupies said brake disengaged elevation. In the preferred embodiment, the base of the conical disks frictionally bears against an inner surface of a respective mounting plate when said braking carriage occupies said brake engaged elevation.

A first rocker member having an input arm and an output arm is mounted below the skate and includes drive pins that engage the braking carriage at the mounting plates and vertically displace the braking carriage through the rotation of said first rocker between the brake engaged elevation and the brake disengaged elevation. A user controlled actuator mechanism coupled to said first rocker at said input arm drives said first rocker in a first direction for moving the braking carriage to the brake engaged elevation, where the actuator mechanism may comprise a pushrod mounted between the first rocker and a second rocker located near the back of the skate. The second rocker is rotated by a linkage such as a wishbone-shaped member that couples a movable portion of the skate boot to the second rocker. The brake assembly includes a restoring member such as a mechanical spring coupled to said first and second rockers for returning said first rocker to a position corresponding to said brake disengaged elevation.

Other features and advantages of the invention will become apparent from the following detailed description, taken in conjunction with the accompanying drawings which illustrate, by way of example, the features of the invention.

BRIEF DESCRIPTION OF THE DRAWINGS

An understanding of the invention may be realized by reference to the drawings and their description below, in conjunction with the detailed description of the preferred embodiment. However, it is to be understood that the drawings and the detailed description is not intended to limit the invention or its scope to only those embodiments depicted or described, but rather the scope of the invention is to be construed solely by the words of the claims appended hereto.

DETAILED DESCRIPTION OF THE PREFERRED EMBODIMENTS

Figure 1:
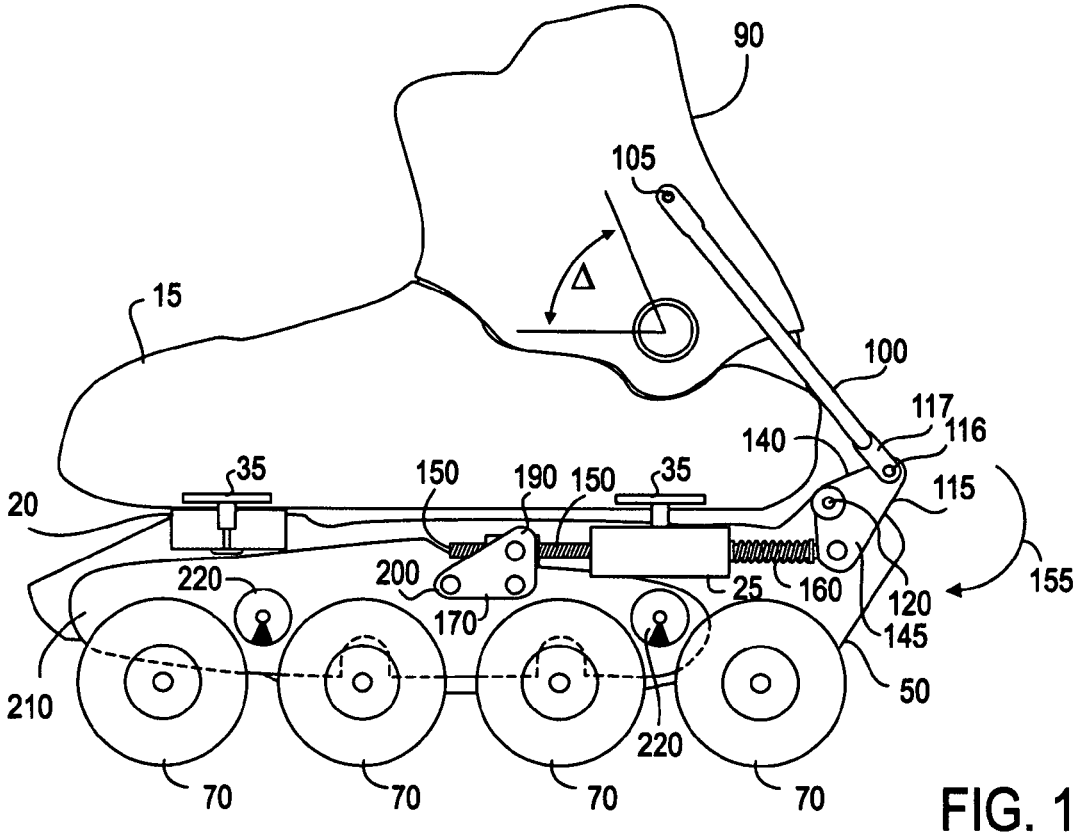
FIG. 1 is a side view, partially in shadow, of the boot and skate brake combination showing the elements of the skate brake in a first embodiment, with the boot in a sleep position and the brake system deactivated.
Figure 2:
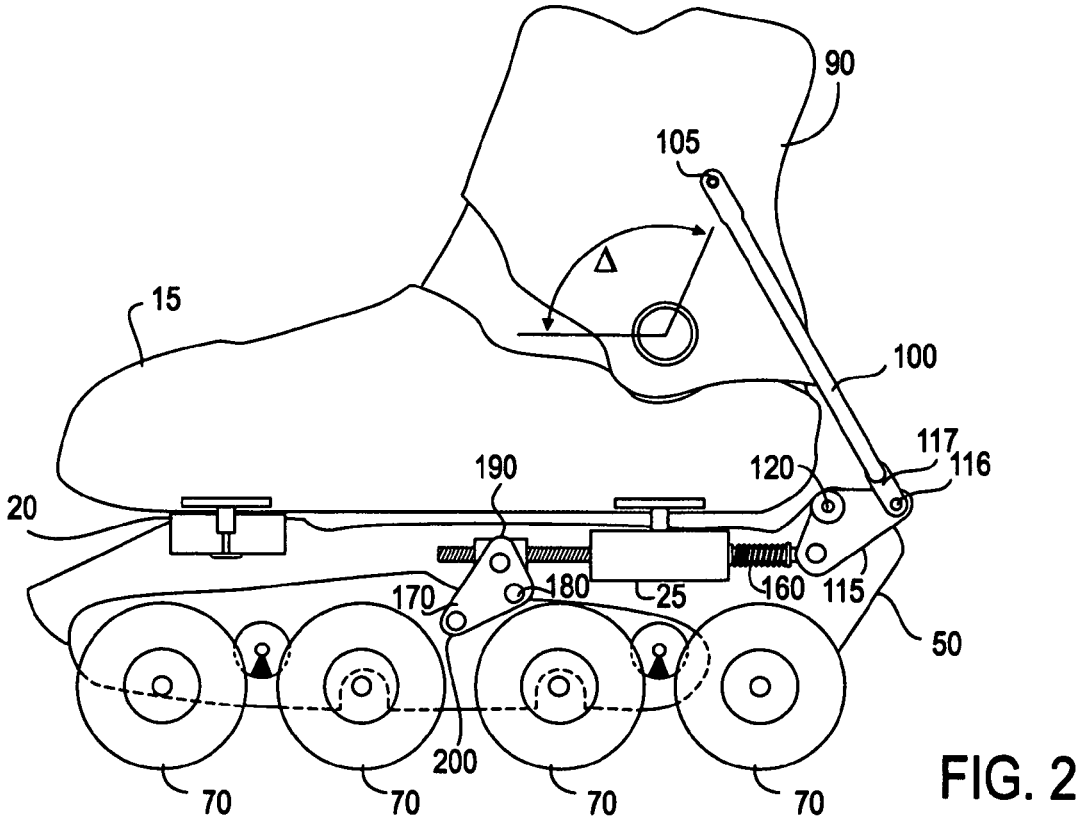
FIG. 2 is a side view, partially in shadow, of the boot and skate brake combination of FIG. 1 with the boot in the flexed position and the brake system active.
Figure 3:
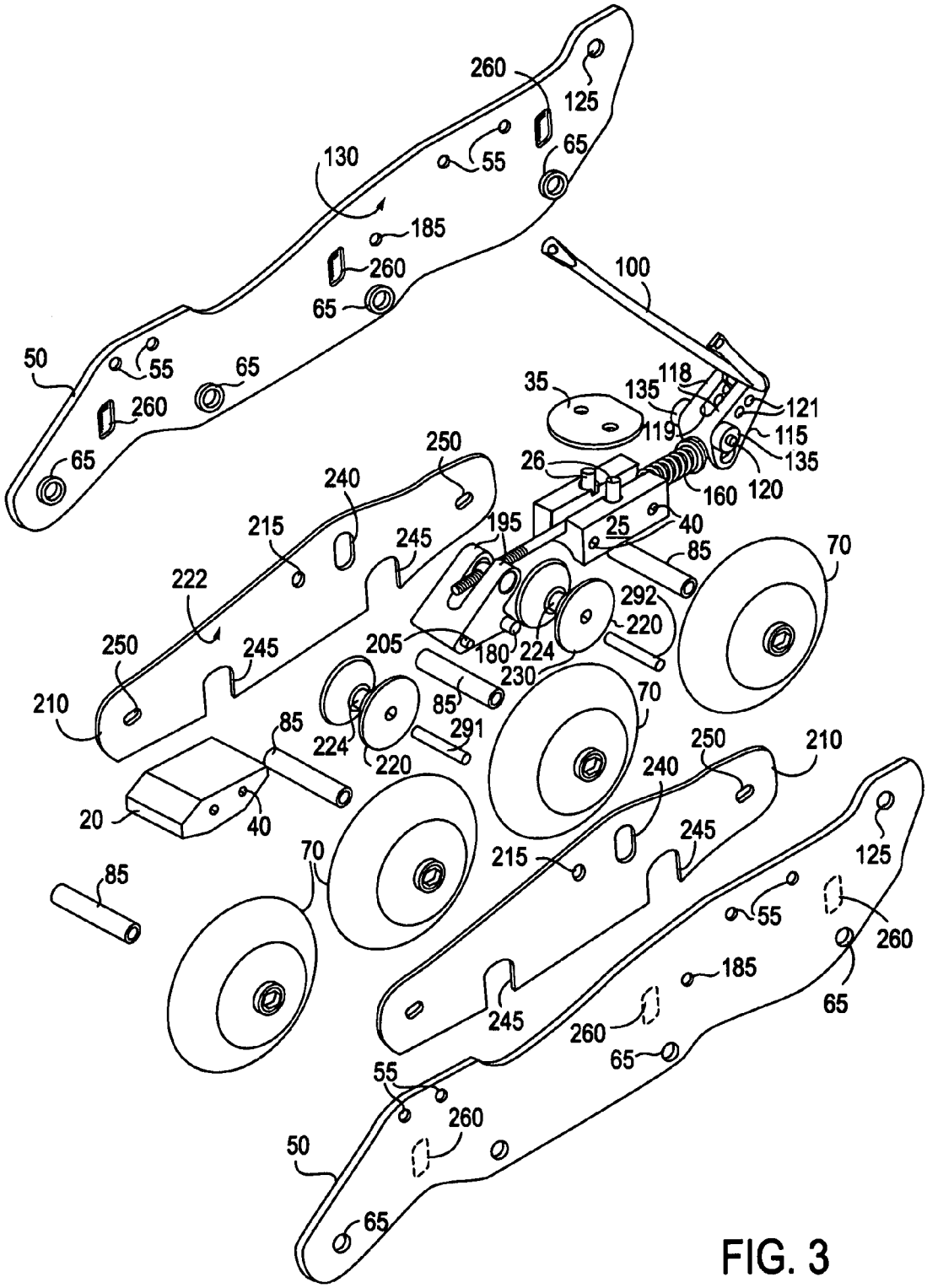
FIG. 3 is an exploded view of the skate brake system of FIG. 1.

A skate equipped with a brake system of the present invention is generally shown in FIGS. 1-3, wherein a skate boot 15 is equipped with a wheel assembly incorporating the braking system. To mount the wheel assembly to the underside of the skate boot 15, a front block 20 is mounted to the underside of the boot 15 just forward of the position of the ball of the foot, and an aft block 25 is mounted to the underside of the boot adjacent the heel. The front and aft blocks can be separate components that are affixed to the bottom of the skate, or with certain molded skate bottoms the blocks can be integrally formed therewith. The front block 20 and aft block 25 may be secured to the boot with simple mechanical fasteners such as a threaded bolts 26, which in combination with a mounting bracket 35 placed inside the boot to fix the blocks to the skate boot (fastener and mounting bracket shown in FIG. 3 only for aft block). In each block 20,25 lateral threaded holes 40 secure left and right wheel chassis plates 50 to the blocks 20,25. The chassis plates 50 include countersunk holes 55 aligned with the lateral threaded holes 40 in the front and aft blocks to receive fasteners (not shown) therethrough, where the fasteners pass through the chassis plates at holes 50 and into the threaded holes 40 to secure the chassis plates 50 to the skate boot blocks 20,25.

The chassis plates 50 also include four countersunk wheel holes 65 equally spaced along their bottom edge and coinciding with the axles 85 of the inline skate wheels 70. Each wheel 70 is mounted between the chassis plates 50 using fasteners 75 which serve to mount each of the four wheels 70 while permitting free rotation of the wheels on their respective axles 85.

The skate boot 15 is further equipped with a hinged or pivoting rear ankle cuff or brace 90 (shown as element 37 in FIG. 1 of U.S. Pat. No. 6,948,723 to the co-inventor, the complete disclosure of which in incorporated herein by reference) formed as part of the boot structure near the Achilles heel area, where the ankle brace 90 is hinged about pins 95 on the left and right sides of the boot 15. The brace 90 can be pivoted or rotated backwards by the skater while skating by extending the skate forward whilst maintaining contact with the ground. This extension of the skater's foot places pressure on the brace by the skater's lower leg, causing a rotational movement about the pins 95 as the brace 90 pivots rearward. In FIG. 1, the unflexed or normal skating position results in an angle Δ between the foot and the leg that is less than ninety degrees, whereas in FIG. 2 the extension of the foot forward results in the angle Δ increasing to greater than ninety degrees. Of course, other skate boot configurations can result in different angles than those shown, which are intended to be exemplary only. This shift in the position of the skater's leg supplies the impetus for the braking system of the present invention.

In a first preferred embodiment, a rigid, wishbone-shaped member 100 is fixed to the ankle brace 90 at first and second ends 105. In general, the wishbone member 100 can be replaced with other configurations for mechanically translating a rearwardly directed force exerted on the brace 90 to an aft rocker 115 mounted behind the skate. The wishbone shaped member 100 is mounted to an aft rocker 115 secured between the chassis plates 50 at the rear portion of the assembly. The aft rocker 115 may be comprised of two parallel spaced apart plates 118 separated by a gap 119 that receives an outwardly projecting tab 117 at the center 110 of the wishbone member 100. The tab 117 preferably includes an aperture sized to receive a pin 116 passing through holes 121 in the spaced apart plates 118 of the aft rocker 115, as well as the aperture in the tab 117 to secure the tab 117 therebetween and thereby rigidly couple the wishbone member 100 to the aft rocker 115. In a preferred embodiment, the spaced apart plates 118 may include a series of holes 121 that may cooperate with the pin 116 to vary the location of the tab 117, thereby adjusting the mechanical advantage or rotational translation of the rocker arm 140 with a given force supplied by the wishbone member 100.

The aft rocker 115 includes a pivot pin 120 about which the aft rocker 115 rotates, where each end of the pivot pin 120 is seated inside respective cavities 125 located on the inner surface 130 of each chassis plate 50. A pair of mechanical spacers 135 ride on the pivot pin 120 on opposite sides of the aft rocker 115 to help position the rocker between the chassis plates 50 and permit free movement of the rocker about its pivot pin 120. The rocker 115 is oriented when in a "sleep" or park status so as to establish an upper arm 140 coupled to the wishbone member 100 at the tab 117, and a lower arm 145 coupled to a pushrod 150.

Further, the rocker 115 is configured such that a rearward movement of the brace 90 by the skater as shown in FIGS. 1 and 2 will exert a force on the upper arm 140 of the rocker 115 through the wishbone member 100, which rotates the upper arm 140 about the pivot pin 120 away from the boot (i.e. clockwise direction shown by arrow 155 in FIG. 1). Rotation of the rocker 115 about the pivot pin 120 causes an accompanying linear, forward translation of the pushrod 150 against the biasing force of a return spring 160. The return spring 160 ensures that the braking carriage discussed below is returned to its home or sleep position after the force on the rocker upper arm 140 is relieved.

Figure 5:
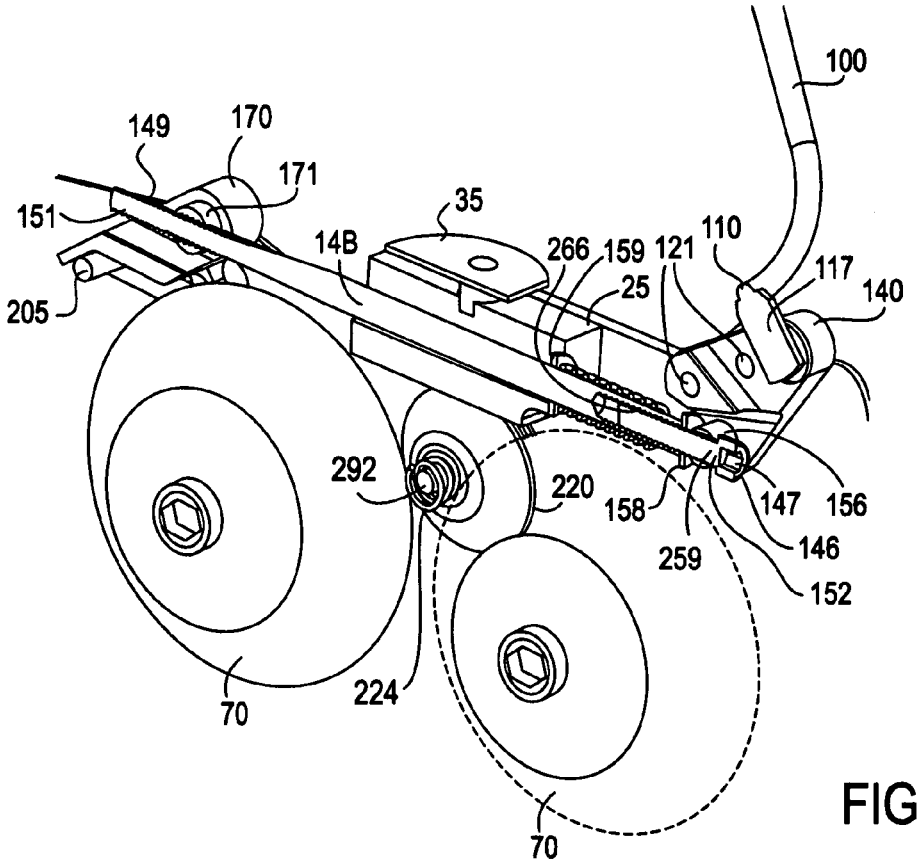
FIG. 5 is an elevated perspective view, partially in shadow, of the interaction of the conical disk with the skate wheels.

As seen in FIG. 5, the pushrod 150 has a head portion 146 at a proximal end 152 that may include a hexagonal opening 147 or alternate slot for receiving a tool, and an elongate body portion 148 having a threaded portion 149 at a distal end 151. The head portion 146 has a larger diameter than the body portion 148, such that the body portion 148 passes freely through a cylindrical lug 156 in the lower arm 145 of the rocker 115 but the head portion 146 is prohibited from passing through the lug 156. The body portion 148 of the pushrod 150 includes a first radially outwardly projecting washer 158 located adjacent the cylindrical lug 156 of the rocker lower arm 145, and a second radially outwardly projecting washer 159 just aft of the channel 165 in the aft block 25. The return spring 160 resides between the washers 158, 159 and supplies the restoring force that resists forward movement of the pushrod 150 and biases the rocker 115 to its non-braking or sleep position shown in FIG. 1.

The pushrod 150 passes through the open channel 165 in the aft block 25 and connects to a front rocker 170 through a second cylindrical lug 171. Unlike the lug 156, the cylindrical lug 171 is preferably threaded to engage the threaded portion 149. Rotation of the pushrod 150, as may be accomplished by placing a suitable tool in the hexagonal opening 147 and rotating the tool, will have the effect of shorting or lengthening the distance between the cylindrical lug 171 of the front rocker 170 and cylindrical lug 156 of the aft rocker 115. The effect of shortening or lengthening the distance between the two rockers is discussed below.

Figure 4:
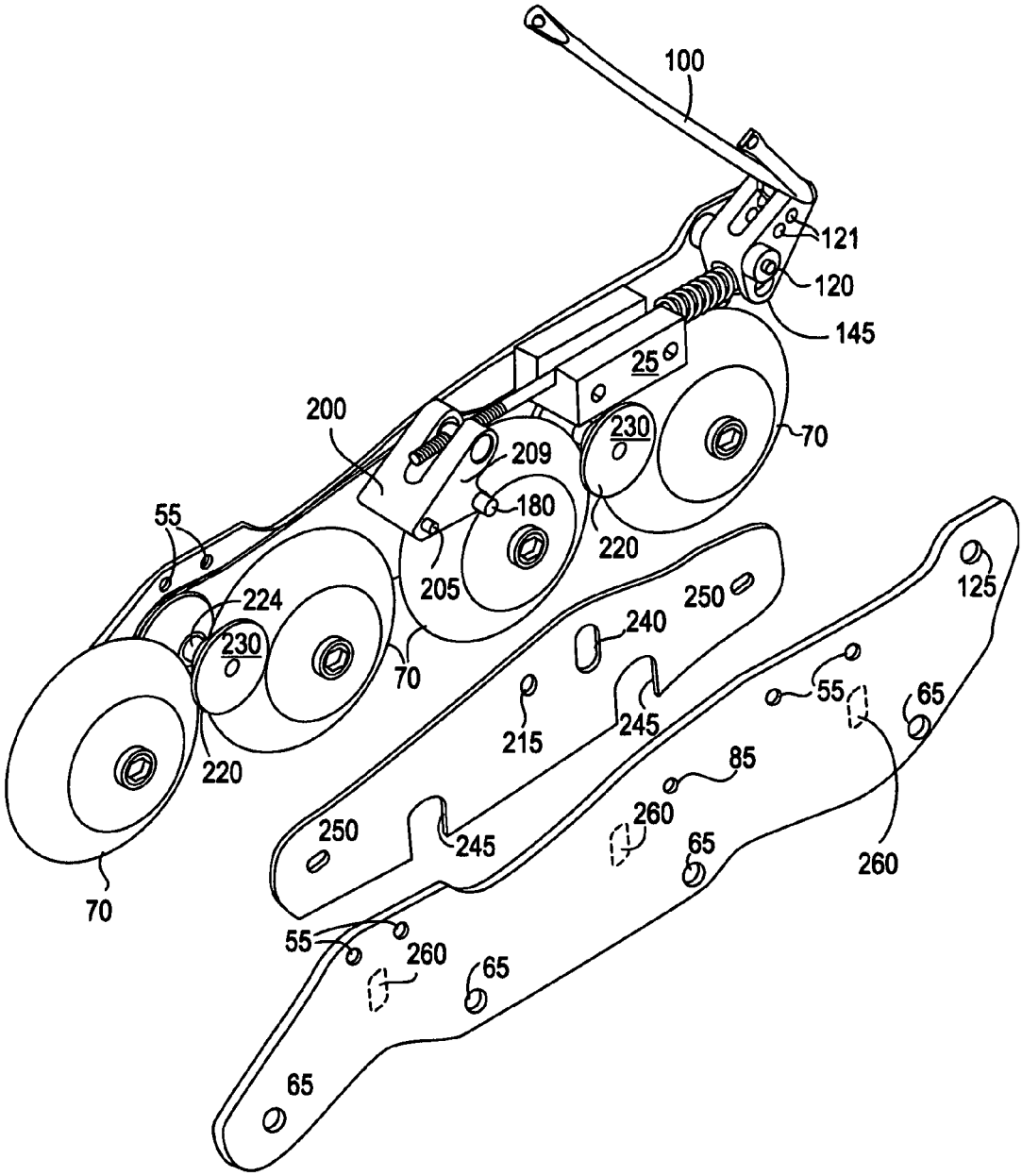
FIG. 4 is an exploded view of the skate brake system of FIG. 1 focusing in the brake wheel interaction.

The front rocker 170 is mounted between the chassis plates 50 via a pivot pin 180 passing through holes 185 in each chassis plate. The upper arm 190 of the front rocker 170 may be comprised of two spaced apart parallel plates 195 each with traverse holes into which the cylindrical lug 171 is received. The lower arm 200 of the front rocker 170 includes a pair of outwardly directed traverse drive pins or projections 205 (see FIG. 4) disposed on opposite side surfaces 209 of the lower arm 200 near an edge thereof. Each projection 205 passes through one of a pair of left and right brake plates 210 at an aperture 215 sized to receive the projection 205. Preferably, the aperture 215 is roughly centered longitudinally to minimize torque on the front rocker arm 170.

The brake plates 210 move substantially in the vertical direction and in unison when driven by the front rocker 170 via the drive projections 205. That is, the brake plates 210 by virtue of the force applied by the projections 205 at the apertures 215 are driven downward as the pushrod 150 moves forward. As may best be seen in FIGS. 6 and 7, fixed between the brake plates 210 are front axle 291 and rear axle 292, where the axles and brake plates 210 cooperate to form a rigid braking carriage. On each axle is seated two frustoconical disks 220 (also referred to as "diabolos") positioned between the first and second wheels 70 and between the third and fourth wheels 70.

Figure 6:
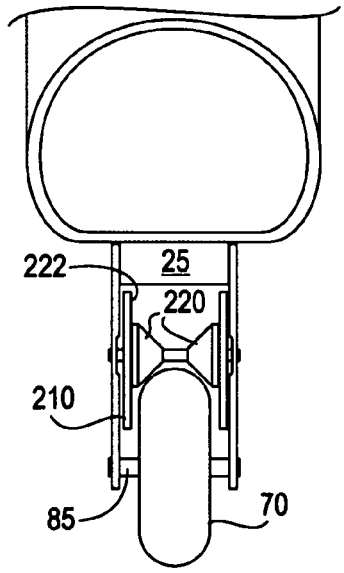
FIG. 6 is a rear view of the brake system of FIG. 1 with the brake system deactivated.
Figure 7:
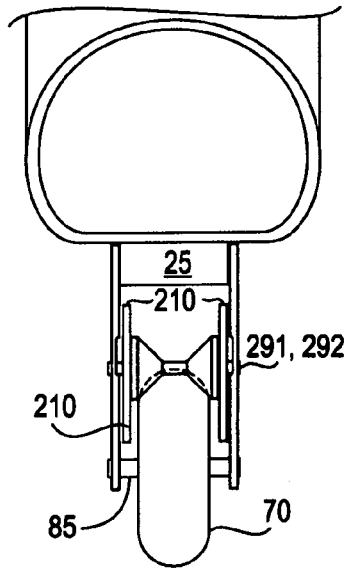
FIG. 7 is a rear view of the brake system of FIG. 1 with the brake system activated.

When the front rocker 170 is in the sleep position the brake plates 210 are positioned such that there is a clearance between the frustoconical disks 220 and the wheels as shown in FIGS. 1 and 6, and there is no braking force applied. However, when the user supplied braking force is applied causing the pushrod 150 to rotate the front rocker 170, the projections 205 on the front rocker 170 drive the brake plates 210 downward thereby engaging the disks 220 against the wheels 70 of the skates as shown in FIGS. 2 and 7. As the disks 210 contact the wheels 70, they are forced outward along the axles 291,292 until the flat braking surface 230 of each disk bears against the inner surface 222 of the brake plates 210. The engagement of the wheels 70 with the conical disks 220 is preferably non-slip, so that the slippage occurs between the braking surface 230 and the brake plate 210. This frictional interaction can be enhanced by making the opposing surfaces rougher, increasing the coefficient of friction between the mating surfaces.

As the disks 220 engage the spinning wheels 70, the disks are slowed by the contact of the base 230 against the brake plates 210 at surfaces 222 such that the momentum of the wheels is retarded or arrested. Because the disks engage the wheels in a preferably non-slip relationship, the slowing of the disks in turn slows the skate wheels. In this manner, the four wheels 70 of the skate are brought to a stop in a controlled manner without locking up the wheels that result in premature wear. In a preferred embodiment, the disks 220 can be separated on their respective axles when in the non-braking position by a simple spring 224, forcing the disks 220 against the brake plates 210 and the brake plates 210 against the chassis plates 50 to prevent vibration and rattling of the disks and plates during operation of the skates.

The brake plates 210 each include an oblong hole 240 through which the pivot pin 180 passes, where the oblong shape in the vertical direction allows the brake plates 210 to move vertically with respect to the fixed pivot pin 180. The brake plates 210 further include cut out portions 245 coinciding with the axes 85 of the second and third wheels 70 to permit clearance between the axes and the lower portion of the brake plate 210. Finally, the brake plates 210 include first and second holes 250 that receive the axles 291, 292 of the disks 220, where said axles extend into a recess 260 formed in the inner surface 130 of each chassis plate 50. The holes 250 are preferably oblong in the horizontal direction to allow the disks 220 to settle into their maximum contact with the wheels 70 coinciding with the lowermost position of the disks 220, such that the pressure of the disks against the adjacent wheels is substantially equal. In the same vein, the mounting of the braking chassis on holes 240 can be configured by widening the holes to allow the braking carriage to locate the optimum position between the skate wheels for equal pressure on all four wheels.

The pushrod 150 can be a single unit or alternatively formed of two separate pieces where an elongate body portion includes an internal longitudinal tapped cavity that receives the end of a head piece. The head piece 146 can be fused to the body portion 148 to form a rigid member that is captivated by the aft rocker 115 at the cylindrical lug 156. As stated above, the cylindrical lug 156 permits rotation of the neck 259 of the head piece, and the joint 266 between the head piece 146 and body portion 148 is fixed such that rotation of the head piece 146 rotates the body portion 148—including the threaded distal end 151 that engages the front rocker 170. Because the coupling of the distal end 151 of the pushrod 150 with the front rocker is threaded, rotation of the head piece 146 will move the aft rocker lower arm 145 backward and forward depending on the direction of rotation, which in turn sets the position of the wishbone 100 that initiates the braking action. Personal preferences and anatomical differences between skaters necessitate adjustment to the relationship between the movement of the skater's leg and the position that begins the braking process, and the change in the effective length of the pushrod via rotation of the head member accomplishes the control over this relationship.

The method and apparatus for carrying out the method described above is illustrative of the present invention. Those of ordinary skill in the art will readily recognize variations of the above-described methods and apparatus, and such variations should be considered within the scope of the invention. The above described methods and apparatus are not intended to the limiting in any manner, and the scope of the invention should be measured by the words of the appended claims, taken in their ordinary meaning in conjunction with the specification and documents cited therein.

We claim:

1. A brake assembly for an inline skate having a boot and linearly aligned wheels, comprising:

a carrier member mounted adjacent to said linearly aligned wheels, said carrier member reciprocating along a substantially vertical path between a brake disengaged elevation and a brake engaged elevation;

a braking roller mounted traverse to said carrier member and aligned to contact at least one wheel for retarding a velocity thereof when said carrier member occupies said brake engaged elevation, said braking roller spaced apart from said at least one wheel when said carrier member occupies said brake disengaged elevation;

a first rocker comprising an input arm and an output arm, said output arm coupled to said carrier member to vertically drive said carrier member between said brake engaged elevation and said brake disengaged elevation;

a user controlled actuator mechanism coupled to said first rocker at said input arm to rotate said first rocker in a first direction, wherein rotating said first rocker in said first direction drives said carrier member to the brake engaged elevation; and a carrier member restoring device coupled to said first rocker for returning said carrier member to said brake disengaged elevation when said user controlled actuator mechanism is inactive.

2. The brake assembly of claim 1 wherein said braking roller comprises first and second spaced apart conical disks positioned to bear against opposite sides of said at least one wheel when said carrier member occupies the brake engaged elevation, and wherein a base of said conical disks comprises a frictional surface that abuts a mating surface on said carrier member when said carrier member is in the brake engaging elevation to retard the velocity of said at least one wheel.

3. The brake assembly of claim 2 further comprising a spring member disposed between said first and second spaced apart conical disks to bias said conical disks against said bearing surface of said carrier member.

4. The brake assembly of claim 1 wherein the user controlled actuator mechanism comprises:

a pushrod configured to rotate said first rocker member at said input arm;

a second rocker member having an input arm and an output, where the output arm is coupled to said pushrod to reciprocate said pushrod; and a mechanical linkage between said boot and said second rocker member's input arm to transfer a user supplied force at the boot to said input arm of said second rocker member.

5. The brake assembly of claim 4 wherein a distance along said pushrod between said first rocker and said second rocker is adjustable by a user.

6. The brake assembly of claim 4 wherein said a carrier member restoring device is a spring.

7. The brake assembly of claim 1 further comprising a second braking roller mounted traverse to said carrier member and aligned to contact at least one wheel not contacted by said first braking roller, for retarding a velocity thereof when said carrier member occupies said brake engaged elevation, and said second braking roller is spaced apart from said at least one wheel not contacted by said first braking roller when said carrier member occupies said brake disengaged elevation, said second braking roller further comprises third and fourth spaced apart conical disks positioned to bear against opposite sides of said at least one wheel not contacted by said first braking roller when said carrier member occupies the brake engaged elevation, and wherein a base of said third and fourth conical disks comprises a frictional surface that abuts the mating surface on said carrier member when said carrier member is in the brake engaging elevation to retard the velocity of said at least one wheel not contacted by said first braking roller.

8. The brake assembly of claim 1 wherein said carrier member is configured to locate said braking roller for contact with two adjacent wheels, and further configured to apply a pressure to said two adjacent wheels equally.

9. The brake assembly of claim 1 wherein said user controlled actuator mechanism is actuated by a user applying a rearward force on a back of said boot.

10. The brake assembly of claim 9 further comprising a user adjustable control for setting a position of said boot as the position when initiation of a braking force is applied by said braking roller.

11. A brake assembly for an inline skate having linearly aligned wheels, comprising:

a braking carriage comprising left and right mounting plates aligned parallel to said aligned wheels and spaced apart by first and second axles, said braking carriage reciprocating in along a substantially vertical path between a brake disengaged elevation and a brake engaged elevation;

first and second braking rollers each mounted on a respective axle of said braking carriage and aligned such that said first and second braking rollers each contact two adjacent wheels for retarding a velocity thereof when said braking carriage occupies said brake engaged elevation, said first and second braking rollers spaced apart from said respective two adjacent wheels when said braking carriage occupies said brake disengaged elevation, said braking rollers each further comprising frictional surfaces that abut a mating mounting plate surface when said braking carriage occupies said brake engaged elevation;

a first rocker member comprising an input arm and an output arm, said output arm coupled to said braking carriage to vertically drive said braking carriage between said brake engaged elevation and said brake disengaged elevation;

a user controlled actuator mechanism coupled to said first rocker at said input arm to rotate said first rocker in a first direction, wherein rotating said first rocker in said first direction drives said braking carriage to the brake engaged elevation; and a braking carriage restoring member coupled to said first rocker for returning said braking carriage to said brake disengaged elevation when said user controlled actuator mechanism is inactive.

12. The brake assembly of claim 11 wherein said braking rollers each comprises a pair of opposed substantially conical disks spaced apart to bear against opposite sides of said respective two wheels when said braking carriage occupies the brake engaged elevation, wherein a base of said conical disks comprises the frictional surface.

13. The brake assembly of claim 12 further comprising a spring member disposed between each of said pair of opposed conical disks to bias said substantially conical disks apart.

14. The brake assembly of claim 11 wherein the user controlled actuator mechanism comprises:

a pushrod configured to rotate said first rocker member at said input arm;

a second rocker member having an input arm and an output where the output arm is coupled to said pushrod to reciprocate said pushrod; and a mechanical linkage between said boot and said second rocker member's input arm to transfer a user supplied force at the boot to said input arm of said second rocker member.

15. The brake assembly of claim 14 wherein a distance along said pushrod between said first rocker and said second rocker is adjustable by a user.

16. The brake assembly of claim 11 wherein said brake carriage restoring member is a spring mounted on said pushrod.

17. The brake assembly of claim 11 wherein said braking carriage is configured to locate said first and second braking rollers so as to apply pressure to said respective two adjacent wheels equally.

18. The brake assembly of claim 11 wherein said user controlled actuator mechanism is actuated by a user applying a rearward force on a back of said boot.

19. The brake assembly of claim 18 further comprising a user adjustable control for setting a position of said boot as the position when initiation of a braking force is applied by said braking roller.

20. A skate having a boot and a plurality of wheels aligned in a line, and a braking system comprising:

a plurality of conical disks mounted on an axle, said conical disks including a wheel contact surface disposed for slipless rolling contact with said wheels, said a bearing surface configured to bear against a frictional surface for arresting a rotation of said wheels;

first and second spaced apart carrier plates mounted adjacent to and on opposite sides of said wheels, said carrier plates including longitudinally slotted holes for receiving said axles mounting said conical disks, and each carrier plate further including an aperture for receiving a drive pin;

a first rocker mounted between said carrier plates for rotation in a plane parallel to said carrier plates, said first rocker having an output arm including first and second drive pins received by said apertures of said carrier plates to vertically displace said carrier plates in unison, said first rocker further comprising an input arm;

a pushrod aligned parallel to said carrier plates and having first and second ends, said first end coupled to said input arm of said first rocker;

a second rocker mounted for rotation in a plane parallel to said carrier plates, said second rocker having an input arm and an output arm, said output arm coupled to said second end of said pushrod for reciprocating said pushrod relative to said input arm of said first rocker;

a wishbone member having a first end coupled to said input arm of said second rocker and a second end connected to said boot; and a spring mounted on said pushrod between first and second washers to bias said pushrod in a direction away from said input arm of said first rocker.

* * * * *